US007474248B2

(12) United States Patent
Nakamura et al.

(10) Patent No.: US 7,474,248 B2
(45) Date of Patent: Jan. 6, 2009

(54) REMOTE CONTROLLER AND REMOTE CONTROL METHOD

(75) Inventors: Tetsuya Nakamura, Ibaraki (JP); Akira Katsuyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 233 days.

(21) Appl. No.: 11/450,473

(22) Filed: Jun. 12, 2006

(65) Prior Publication Data

US 2006/0290559 A1 Dec. 28, 2006

(30) Foreign Application Priority Data

Jun. 24, 2005 (JP) ..... 2005-185277

(51) Int. Cl.
*G08C 17/00* (2006.01)

(52) U.S. Cl. ..... 341/176; 340/825.69; 345/168; 345/169

(58) Field of Classification Search ..... 341/176; 340/825.69; 345/168, 169
See application file for complete search history.

(56) References Cited

U.S. PATENT DOCUMENTS 5,450,079 A * 9/1995 Dunaway ..... 341/23

* cited by examiner

*Primary Examiner*—Albert K Wong
*Assistant Examiner*—Hung Q Dang
(74) *Attorney, Agent, or Firm*—Oblon, Spivak, McClelland, Maier & Neustadt, P.C.

(57) ABSTRACT

A remote controller includes: a plurality of function keys provided for each of a plurality of target devices as one type of key out of a plurality of keys provided in the controller, and adapted to select the target device to be remotely controlled; a key illuminating section adapted to individually illuminate the plurality of function keys; and a controller adapted to cause, if a certain function key out of the plurality of function keys is pressed, the key illuminating section to illuminate the pressed function key for a predetermined length of time, and output a remote control signal for the target device corresponding to the pressed function key by operating the operation key during the illumination, the controller further adapted to output a remote control signal for a preliminarily registered target device if the operation key is operated while none of the function keys are illuminated.

3 Claims, 8 Drawing Sheets

POWER KEY OF TV RECEIVER

VOLUME MINUS KEY

CHANNEL MINUS KEY

LED OF FUNCTION KEY

CODE TRANSMISSION

POWER KEY OF TV RECEIVER

VOLUME MINUS KEY

CHANNEL MINUS KEY

LED OF FUNCTION KEY

CODE TRANSMISSION

FUNCTION KEY
ON
OFF

MUTE KEY
ON
OFF

LED OF FUNCTION KEY
ON
OFF
SELECTED FUNCTION KEY
ALL LEDS
SELECTED FUNCTION KEY
2 SECONDS
500 MILLISECONDS

REMOTE CONTROLLER AND REMOTE CONTROL METHOD

BACKGROUND OF THE INVENTION

1. Field of the Invention

The present invention relates to a remote controller and remote control method preferably applicable, for example, to infrared transmission of control signals to a photo-receiver provided to electronic device such as television receivers.

2. Description of Related Art

Remote controllers utilizing infrared wireless transmission of control signals have been used for remotely controlling video device such as television receivers and audio device. In a channel-selection operation of a television receiver or the like using the remote controller, a user selects one of numeral keys provided on the remote controller, and presses it down. By this operation, an infrared remote control signal corresponding to the selected keys is transmitted from the remote controller to the television receiver. In the television receiver, channel positions are preset for corresponding remote control signals. In response to the reception of the remote control signal, the channel, the positions of which correspond to different broadcasting stations, is switched, thereby completing the channel-selection operation.

There is also known a system having an electronic device such as television receiver and AV (audio-visual) amplifier provided with a plurality of input terminals, and external devices such as various recorders, players, tuners and the like connected to the input terminals, so as to allow a single remote controller to remotely control the various device. The remote controller used in such a system allows operating not only the television receiver or the AV amplifier, but also any connected external devices. In switching of the device to be operated, the user starts with an input switching operation on the television receiver side. For example, if a television receiver is provided with four input terminals from a first input terminal to a fourth input terminal, the input terminals are preset to different external devices such that the first input terminal is for a DVD recorder, the second terminal is for video deck and so on. The connected external devices are selected by switching the input of the television receiver. This type of the remote controller has provided thereon operation switch keys for selecting the device to be operated from the connected external devices of the television receiver, DVD (digital versatile disk) recorder, AV amplifier and so forth. After switching the input of the television receiver, the user can operate a desired device by changing modes of the remote controller using the operation switch keys disposed thereon.

For example, if a user, who has been viewing a terrestrial analog broadcasting, wishes to switch the operation to a DVD recorder for replaying of a DVD. The user first switches the input terminal of the television receiver to one through which the DVD recorder is connected. Further, the user operates the switch key of the remote controller to select the DVD recorder. An infrared remote control signal corresponding to the operation of the DVD recorder is then from the remote controller to the television receiver. Accordingly, the user is thus allowed to perform operations of record, play, stop and so forth with the DVD recorder.

Various techniques have been proposed aiming at switching operations for other electronic devices. Examples of the techniques include keeping of a selection mode of a specific electronic device, unconditional recovering of a mode of a specific electronic device, recognizing of operation switching among electronic devices using a slide switch, and identifying of switching operation to any other device and allowing the keys to be operated appropriately with a pre set zoning functionality.

Japanese Patent Application Publication Number 2001-204089 and its FIG. 1 discloses a technique of outputting, from a remote controller, operation codes for peripheral devices connected to a television receiver.

SUMMARY OF THE INVENTION

These various techniques are, however, not available together, and the user is forced to use a remote controller conforming only to individual device specifications. Remote control of an electronic device having a large number of slide switches raises issues in control quality, such as reliability of the switching device, inconvenience in positional recognition (display), and reliability of the switch per se. The zoning is far from a satisfactory level of operation due to a limited number of keys. It has also been becoming more difficult to make operations so as to make full use of connections with any new type of electronic devices which have kept on increasing in recent years, and their product values.

Accordingly, it is desirable to provide means for allowing a user to easily perform an setting operation for controlling a desired electronic device in a case where a plurality of electronic devices are arranged to accept controlling of a remote controller. The present invention is conceived after considering the above-described situation.

The present invention may be applicable to a case where a remote control signal corresponding to each of a plurality of target devices to be controlled can be transmitted by mode switching operation. It makes it possible to select a target device to be remotely controlled, by operating a plurality of function keys provided for each of a plurality of target devices. In one embodiment of the present invention, each of the plurality of function keys can be individually illuminated. If a certain function key of the plurality of function keys is pressed, the pressed function key is illuminated for a predetermined length of time, and a remote control signal for the target device corresponding to the pressed function key is transmitted by operating the key during the illumination period. Furthermore, a remote control signal for a preliminarily registered target device is transmitted by operating a key when none of the function keys are illuminated.

Such a configuration makes it possible to switch the electronic device to be remotely controlled.

The present invention enables to switch the electronic device to be controlled and allow appropriate settings in response to a condition of use, which may be different for a different user, thereby improving the ease of operation.

DETAILED DESCRIPTION OF THE EMBODIMENTS

Below, one embodiment of the present invention is described with reference to the attached drawings. The present embodiment relates to a remote controller and its device operation system capable of remotely controlling a television receiver by transmitting a predetermined infrared control signal to the television receiver through key operation by the user.

Figure 1:
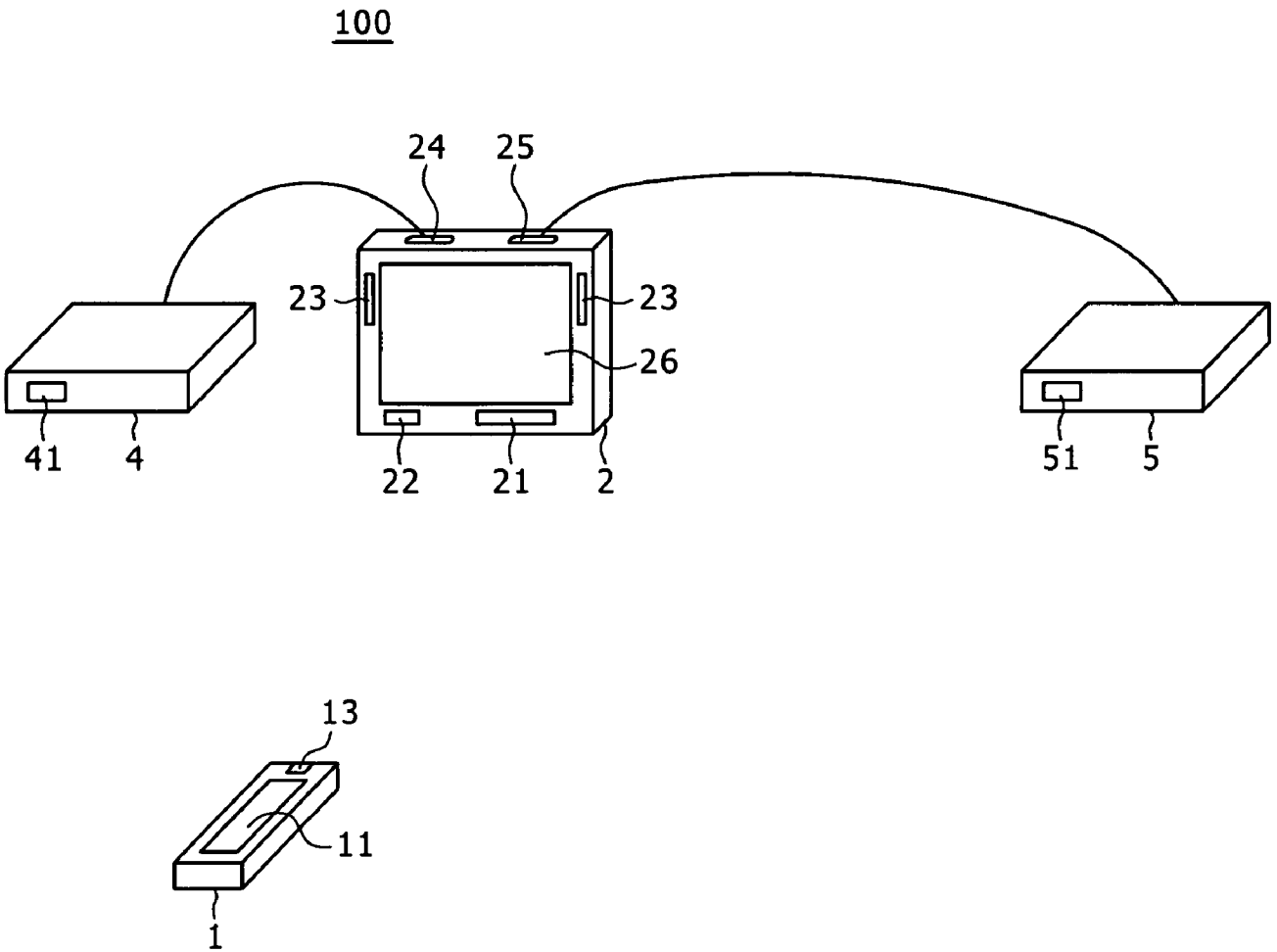
FIG. 1 is a drawing showing a configuration of an exemplary device operation system in one embodiment of the present invention.

First, an exemplary configuration of the device operation system of the present embodiment will be explained with reference to FIG. 1. A television receiver 2, capable of displaying image or video, converts signals of broadcasting wave received by an antenna (not shown in the figure), thereby receiving a television broadcasting program. As peripheral devices set externally, there are provided a DVD recorder 4 capable of recording and playing an optical disc as a recording medium specified by the DVD standard, and a video deck 5 capable of recording and playing a video tape. The devices are respectively connected through cables to a first input terminal 24 and a second input terminal 25 provided in the television receiver 2, allowing video and audio play signals to be supplied therethrough. In the following description, the system thus configured by connecting the DVD recorder 4 and the video deck 5 to the television receiver 2, as being controllable by a remote controller 1, is referred to as a device operation system 100. The television receiver 2 is provided with a liquid crystal display panel 26, and speakers 23 for audio output disposed on both sides of the display panel 26, so as to receive television broadcasting, and play video and audio data provided from the DVD recorder 4, and the video deck 5. The television receiver 2 is also provided with an operation section 21 allowed for operations such as channel selection, volume setting and so forth.

The remote controller 1 allowing the user to remotely control the DVD recorder 4 and the video deck 5 as well as the television receiver 2 by switching an operation mode. The remote controller 1 has an operation section 11 having various keys provided therein, and light emitting section 13 for transmitting infrared signals. An exemplary external configuration and an exemplary internal configuration of the remote controller 1, and details of the processing will be detailed later.

The DVD recorder 4 and the video deck 5 are respectively provided with receivers 41, 51 receiving the infrared signals sent from the remote controller 1. On the remote controller 1, there are provided function keys 11*d*, 11*e*, 11*f* and 11*g* used for switching operations of the external devices described later, allowing the user to select the function keys 11*d* to 11*g* so as to switch the external devices to be operated. For example, by pressing the function key 11*d* of the remote controller 1 to switch the operable electronic device to "DVD", the user can remotely control the DVD recorder 4 through the remote controller 1. Furthermore, on the television receiver 2, there is provided a photo-receiver 38 detecting infrared signals sent from the remote controller 1, and subjecting them to a photoelectric conversion. It is therefore made possible to operate channel and volume of the television receiver 2, by pressing the function key 11*g* of the remote controller 1 to switch the operable electronic device to "TV".

Figure 2:
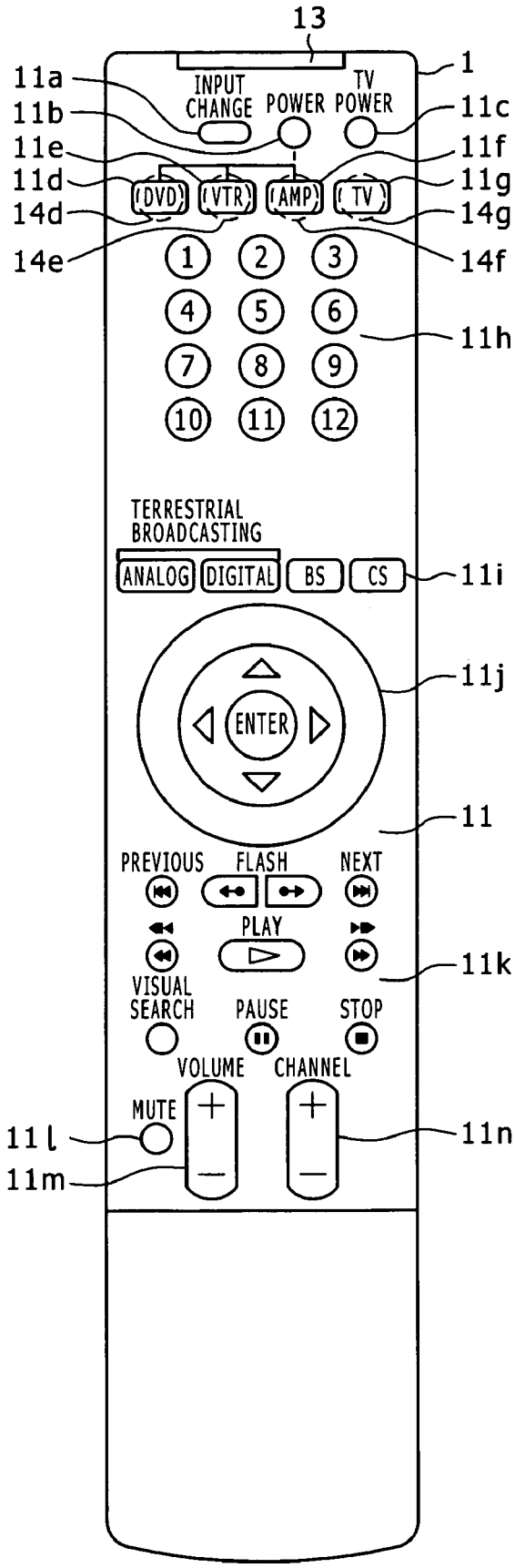
FIG. 2 is a drawing showing an external configuration of an exemplary remote controller in one embodiment of the present invention.

Next, an exemplary external configuration of the remote controller 1 of the present embodiment will be described with reference to FIG. 2. The remote controller 1, allowing therethrough remote control of the electronic devices such as a television receiver, is molded in a form of square box typically using a synthetic resin, and is provided with a light emitting section 13 for sending infrared signals using LED (light emitting diode) as a light emitting element.

The remote controller 1 has an operation section 11 containing various operation keys. The operation section 11 has an input switching key 11*a* for switching inputs of the television receiver 2. Function keys for switching the target device of the remote controller are also provided. The remote controller 1 of the present embodiment has a function key 11*d* indicated as "DVD" for switching the target device to the DVD recorder 4, a function key 11*e* indicated as "VTR" for switching to the video deck 5, a function key 11*e* indicated as "AMP" for switching to an amplifier (not shown in the figure), and a function key 11*f* indicated as "TV" for switching to the television receiver 2. These function keys 11*d* to 11*f* are molded with semi-transparent resin, and respectively have light emitting elements 14*d* to 14*f*, typically including LEDs for emitting visible light, disposed inside thereof. The individual light emitting elements 14*d* to 14*f* form respective key illuminating section 14, which will be described later.

There are also provided a broadcasting switching keys 11*i* including "Analog" for switching to an analog broadcasting, "Digital" for switching to a digital broadcasting, "BS" for switching to "BS" (broadcasting satellite) broadcasting, and "CS" for switching to CS (communications satellite) broadcasting. These switching over operation is performed when "Television" mode is selected. The remote controller 1 of the present embodiment is capable of not only changing, upon switching among the function keys 11*d* to 11*g*, codes for the target device corresponding to the remote control signal transmitted by the remote controller 1 per se, but also to transmitting a remote control signal to switch the input to the television receiver 2.

The operation section 11 is provided with a television power key 11*c* for causing on/off of the power of the television receiver 2 when the "Television" mode is selected. For the case where the target device is the television receiver 2, the remote control signal for power control, transmitted through operation of the television power key 11*c*, switches the state of the power of the television receiver 2 from either one of the ON state and the OFF state to the other. The operation section 11 is similarly equipped with a power key 11*b* causing on/off of the power of the target device switched by the function keys 11*d* to 11*g*. When the individual modes of "DVD", "VTR" and "AMP" are selected, the remote control signal for power control, transmitted through operation of the power key 11*b*, changes the state of power of the target electronic device to be operated from one of ON state and OFF state to the other.

The remote controller 1 is provided with ten-keys 11*h* as direct keys, having numerals from "1" to "12" printed thereon, allowing the user to directly press it for channel selection. Channel selection position can be specified by transmitting a remote control signal of a code assigned to each of the ten-key 11*h* to the television receiver 2. For the case where the operation mode of the device is set other than the television receiver 2, the ten-key 11*h* functions as a key for specifying channel selection position of thus set device.

A selection key 11*j* is formed with up, down, left and right arrow keys and "enter" key enables operation of displaying menu such as functions, contents and so forth on a display panel 26 of the television receiver 2, moving the cursor, and selecting and entering necessary items. Operation keys 11*k* allowing operations of "play", "pause", "stop" and so forth for the DVD recorder 4 and the video deck 5 are operable when the mode of the remote controller 1 is set to "DVD" and "VTR", respectively.

A mute key 11*l* provided for volume control functions as changing audio output of the television receiver 2, from either one of the ON state and OFF state to the other. Furthermore, a volume key 11*m* has a plus key and a minus key, wherein the plus key increases volume, and the minus key reduces volume. A channel key 11*n* has a plus key and a minus key, wherein the plus key results in up-operation of position of channel selection, and the minus key results in down-operation of position of channel selection.

Figure 3:
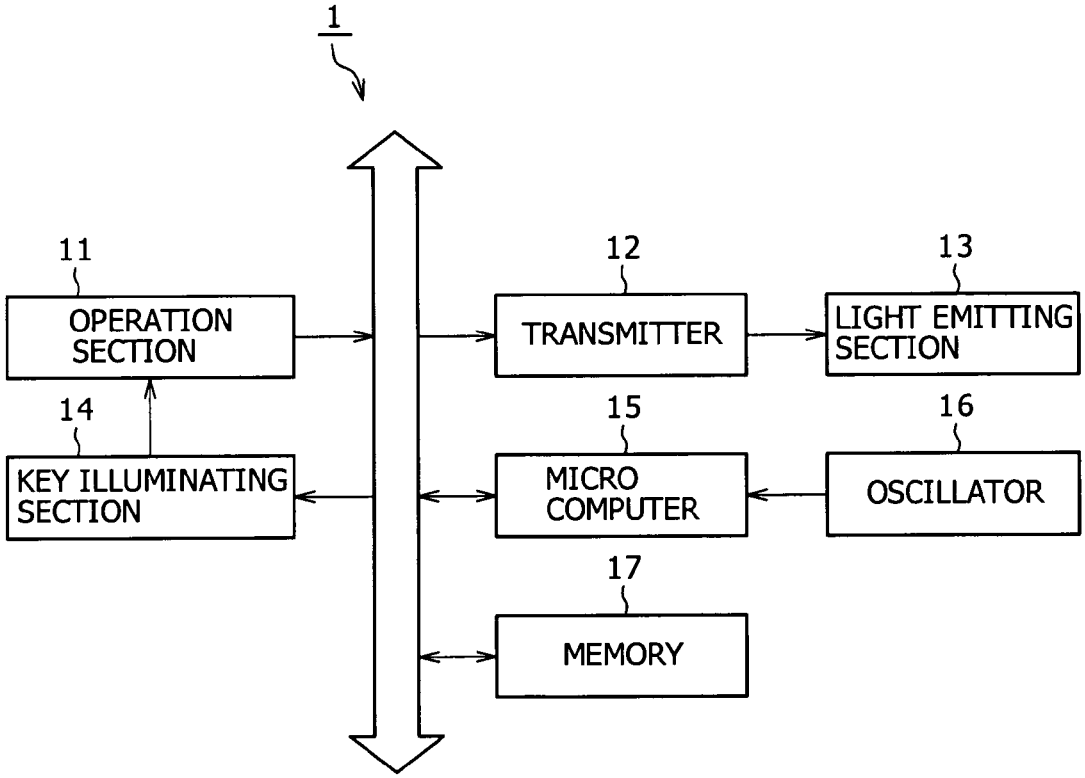
FIG. 3 is a drawing showing an internal configuration of an exemplary remote controller in one embodiment of the present invention.

Next, an exemplary internal configuration of the remote controller 1 of this embodiment is described with reference to a block diagram shown in FIG. 3. Key codes entered by the user through the individual keys in the operation section 11 are supplied to a microcomputer which takes part in internal control of the remote controller 1. A memory 17 temporarily stores data typically using a rewritable RAM (random access memory). The memory 17 also has operating programs, parameters, codes corresponding to the operation keys stored therein, typically using a ROM (read only memory) allowing reading therefrom only. The microcomputer 15 reads an operating program or the like from the memory 17, executes it based on frequency of an oscillator 16 supplying a constant clock, and supplies a code to a transmitter 12. The transmitter 12 modulates the supplied code so as to adapt it to sending, and supplies thus-modulated code to be sent (remote control signal) to the LED in the light emitting section 13. The infrared remote control signal is thus sent from the light emitting section 13 to a photo-receiver 34 of the television receiver 2.

The remote controller 1 of the present embodiment is configured such that, in mode switching using the function keys 11*d* to 11*g*, a key illuminating section 14 formed with LEDs illuminates the function keys for a predetermined length of time. The function keys 11*d* to 11*g* are thus configured as self-illuminating keys, which are highly visible by the user. Processing of illuminating the function keys will be detailed later.

Figure 4:
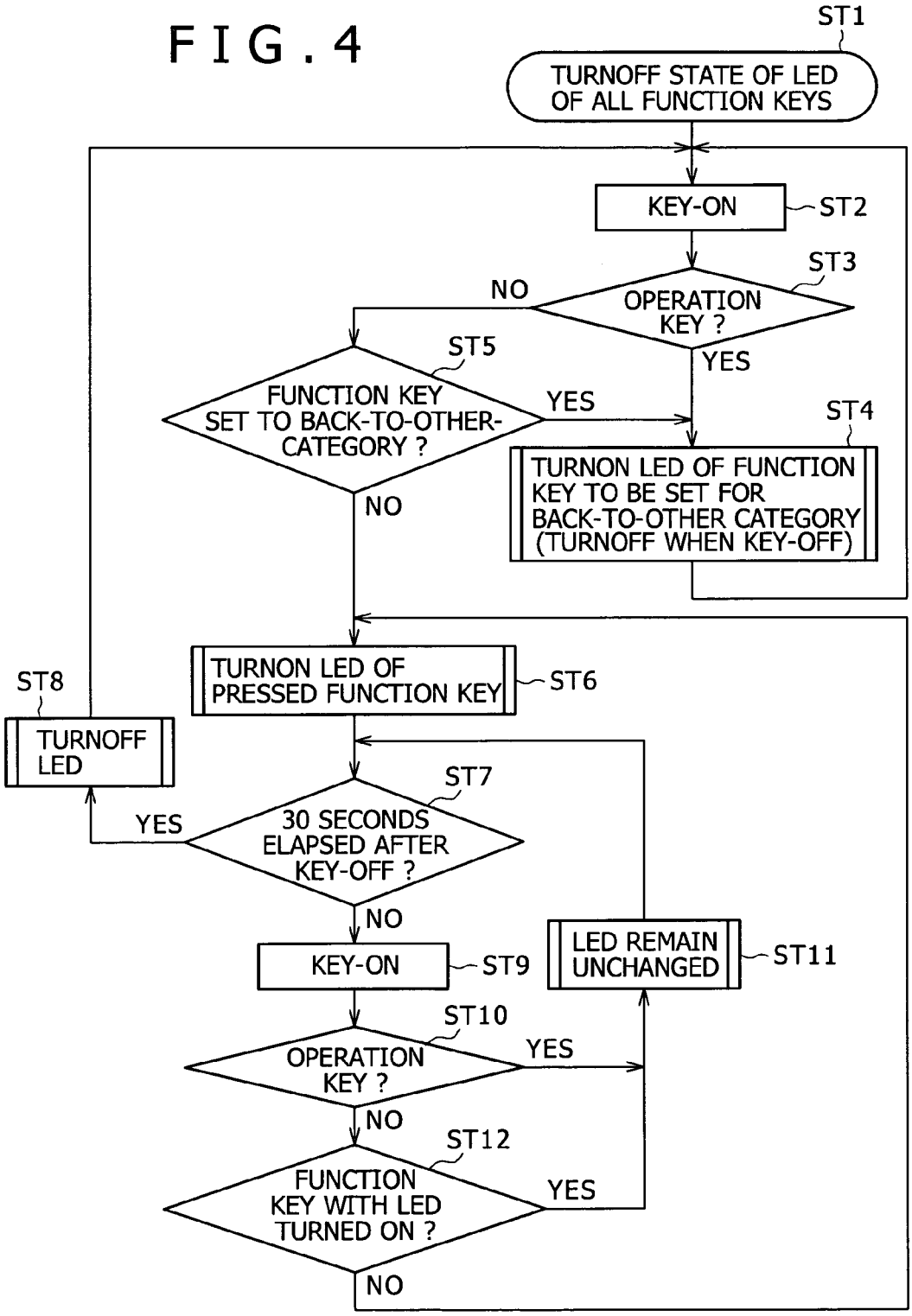
FIG. 4 is a flow chart showing an exemplary processing of back-to-other-category setting.
Figure 5:
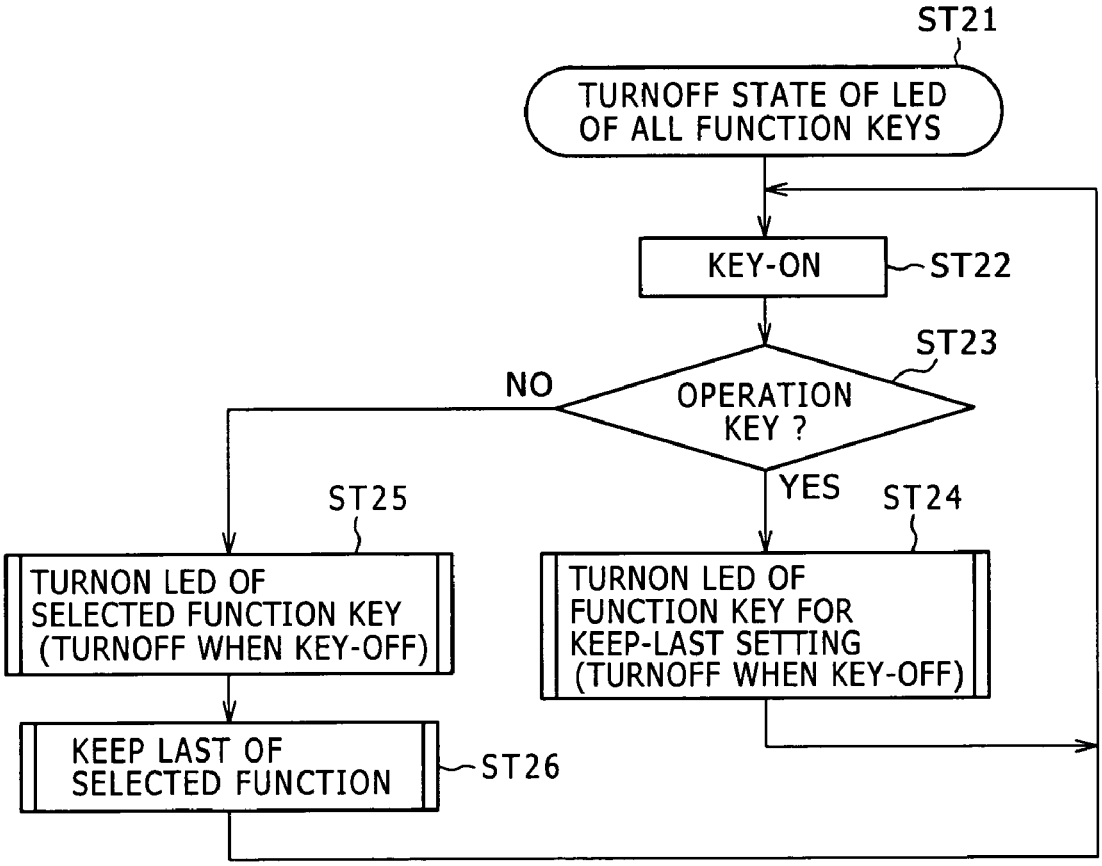
FIG. 5 is a flow chart showing an exemplary processing of keep-last setting in one embodiment of the present invention.

Next, settings of "back-to-other-category" and "keep-last" of the remote controller 1 of this embodiment are described with reference to the flow charts in FIG. 4 and FIG. 5.

The "back-to-other-category" setting enables an operation for keeping the LED illuminated when any other function is selected, and allowing operation of the electronic device corresponding to the selected function only during illumination period of the LED. The operation is switched to a preliminarily set mode when the LED of the function key is not illuminated. In other words, the settings are such that the mode is forced back to a mode corresponding to a function of a preliminarily determined electronic device if any function key corresponding to an electronic device of other type (category) is pressed and then released under a predetermined condition (for example, a key-off time exceeds a predetermined length of time).

The "keep-last" setting keeps the last-selected device mode of use, and treats next pressing of a key as in the same device mode. In other words, the setting is such as keeping the device mode until the next function switching is made once a certain function switching takes place.

First, an exemplary processing of the "back-to-other-category" setting will be explained with reference to FIG. 4. It is now assumed that a target device for the "back-to-other-category" setting is the television receiver 2, and the mode of the remote controller 1 is "TV". An exemplary processing assumed herein is such that the user presses the function key 11*d* to thereby switch the mode of the remote controller 1 to "DVD".

In the beginning, it is confirmed that all LEDs built in the function keys 11*d* to 11*g* are in the turned off state (step ST1). Next, the user presses any of the operation keys provided in the operation section 11 (step ST2). Such a pressing operation is referred to as "key-on" in this description. The microcomputer 15 judges whether the pressed key is a key other than any one of the function keys 11*d* to 11*g* or not (step ST3).

If the pressed key is a key other than any one of the function keys 11*d* to 11*g*, the LED of the function key 11*g* corresponding to the electronic device ("TV" in the present embodiment) specified by the "back-to-other-category" setting is turned on (step ST4). The LED is turned off upon releasing of the pressed operation key. This releasing operation is referred to as "key-off" in this description. On the other hand, if the pressed key is the function key lid ("DVD" in the present embodiment), whether the key is a function key corresponding to the electronic device specified by the "back-to-other-category" setting (step ST5). If the key is a function key of the electronic device specified by the "back-to-other-category" setting, the process advances to step ST4, and turns on the LED of the function key 11*g* corresponding to the electronic device specified by the "back-to-other-category" setting. The "TV" key is illuminated in the present embodiment.

If the pressed key is not a function key corresponding to the electronic device specified by the "back-to-other-category" setting, the LED of the pressed function key 11*d* is turned on (step ST6). In this embodiment, the "DVD" key is illuminated. The LED of the function key 11*d* is kept turned on even if it is brought into the key-off state, so far as a predetermined length of time has not elapsed.

Whether 30 seconds, for example, have elapsed after the key-off of the function key 11*d* or not is then judged (step ST7). If 30 seconds have elapsed, the LED of the function key 11*d* is turned off (step ST8). If the key-on occurred within 30 seconds (step ST9), whether the key is a function key other than the function key 11*d* or not is then judged (step ST10). If the operation key other than the function key lid is pressed, the LED of the function key 11*d* is remained turned on (step ST11). The "DVD" key is illuminated in the present embodiment.

If any one of the function keys 11*d* to 11*g* is brought into the key-on, whether the key is the function key with its LED being illumined ("DVD" in the present embodiment) or not is judged (step ST12). If the pressed key is the function key 11*d* with its LED being turned on, the LED of the function key 11*d* is remained turned on (step ST11). The "DVD" key is kept illuminated in the present embodiment. If the pressed key is not the function key with its LED being turned on (for example, the "VTR" key), the LED of the function key 11*e* is turned on (step ST6). The "VTR" key is illuminated in the present embodiment.

Next, an exemplary processing of the "keep-last" setting will be explained with reference to FIG. 5. It is now assumed that the target device for the "keep-last" setting is the television receiver 2, and the mode of the remote controller 1 is "TV". An exemplary processing assumed herein is such as switching the mode of the remote controller 1 to be set to "keep-last" to "DVD".

In the beginning, it is confirmed that all LEDs built in the function keys 11*d* to 11*g* are in the turned off state (step ST21). Next, the user presses (the key-on) any of the operation keys provided in the operation section 11 (step ST22). A microcomputer 15 judges whether the pressed key is other than any one of the function keys 11*d* to 11*g* or not (step ST23).

If the pressed key is an operation key other than the function keys 11*d* to 11*g*, the LED of the function key 11*d* corresponding to the electronic device specified by the "keep-last" setting is turned on (step ST24). The "TV" key is illuminated in the present embodiment. The LED is turned off by releasing the pressed operation key (the key-off). On the other hand, if the pressed key is the function key 11*d* ("DVD" in the present embodiment), the LED of the selected function key 11*d* is turned on (step ST25). The function key 11*d* is thus brought into the keep-last state (step ST26).

Processing of the "back-to-other-category" setting and the "keep-last" setting is thus carried out.

Below, exemplary processes of changing the "keep-last" setting and the "back-to-other-category" setting of the remote controller 1 of this embodiment are described with reference to the timing charts in FIGS. 6A to 6E and FIGS. 7A to 7E.

In the normal operation mode, the user can alter the keep-last state after pressing of the function key by performing setting of "sequential triple pressing of (television power key)+(volume minus key)+(channel minus key)". Repetition of this setting makes it possible to switch the "keep-last" setting and the "back-to-other-category" setting.

Figures 6A, 6B, 6C, 6D, 6E:
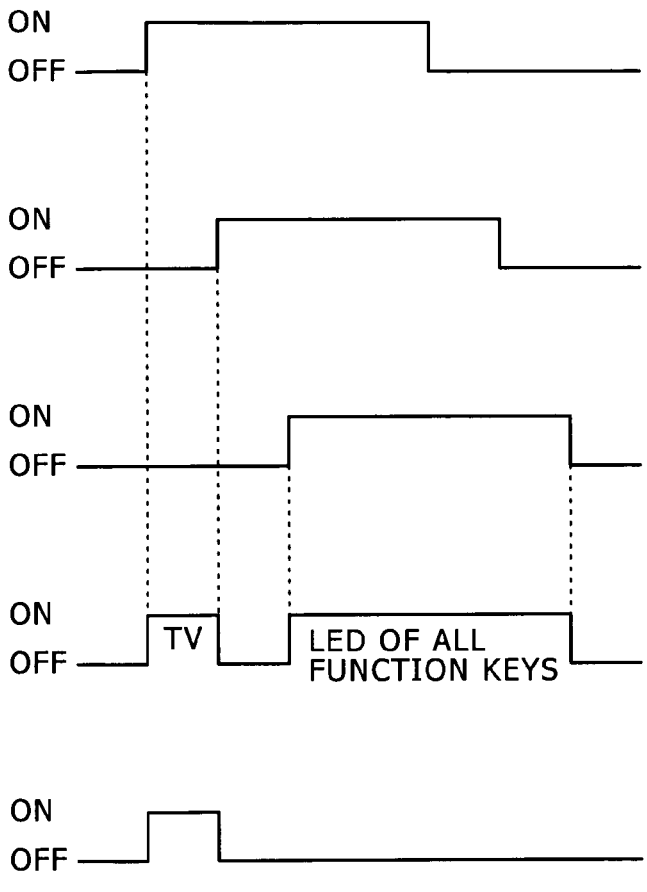
FIGS. 6A to 6E are explanatory drawings showing exemplary timing charts for a process of switching from back-to-other-category setting to keep-last setting in one embodiment of the present invention.

FIGS. 6A to 6E show exemplary timing charts for a process of switching from the "back-to-other-category" setting to the "keep-last" setting. FIG. 6A shows on/off of the television power key 11*c*, FIG. 6B shows on/off of the minus key of the volume key 11*m*, FIG. 6C shows on/off of the minus key of the channel key 11*n*, FIG. 6D shows illumination/non-illumination of the LED of the function key, and FIG. 6E shows on/off of transmission of the power code of the television power key 11*c*.

As shown in FIG. 6A, the process begins with the key-on of the television power key 11*c*. The television power key 11*c* is kept pressed. As shown in FIG. 6D, the LED of the "TV" key of the function key 11*g* is turned on. As shown in FIG. 6E, a code (remote control signal) of the television power key 11*c* is transmitted from the remote controller 1 to the television receiver 2.

Next, as shown in FIG. 6B, the minus key of the volume key 11*m* is pressed. The code transmission of the television power key 11*c* is interrupted upon the key-on of the minus key of the volume key 11*m*, and the LED indicating "TV" on the function key 11*g* is turned off. The minus key of the volume key 11*m* is kept pressed. Next, as shown in FIG. 6C, the minus key of the channel key 11*n* is pressed. The minus key of the channel key 1 in is kept pressed.

By sequentially pressing three these keys, as shown in FIG. 6D, all function keys 11*d* to 11*g* ("DVD", "VTR", "AMP", "TV") are illuminated. By sequentially releasing the pressed television power key 11*c*, the minus key of the volume key 11*m* and the minus key of the channel key 11*n*, the illuminations of all function keys 11*d* to 11*g* are turned off, thereby completing change of setting.

FIGS. 7A to 7E show exemplary timing charts for a process of switching from the "keep-last" setting to the "back-to-other-category" setting. Each of the FIG. 7A to FIG. 7E show the timing charts of the same keys and codes with FIGS. 6A to 6E.

Figures 7A, 7B, 7C, 7D, 7E:
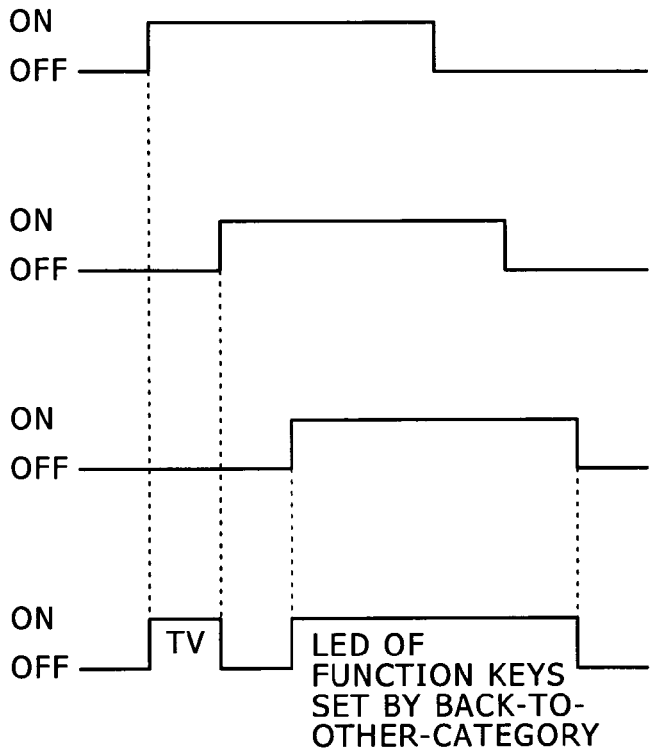
FIGS. 7A to 7E are explanatory drawings showings exemplary timing charts for a process of switching from keep-last setting to back-to-other-category setting in one embodiment of the present invention.

First, as shown in FIG. 7A, the television power key 11*c* is pressed. The television power key 11*c* is kept pressed. At the same time, as shown in FIG. 7D, the LED indicating "TV" on the function key 11*g* is turned on. As shown in FIG. 7E, a code (remote control signal) of the television power key 11*c* is transmitted from the remote controller 1 to the television receiver 2.

Next, as shown in FIG. 7B, the minus key of the volume key 11*m* is pressed. The code transmission of the television power key 11*c* is interrupted. Upon the key-on of the minus key of the volume key 11*m*, and the LED indicating "TV" on the function key 11*g* is turned off. The minus key of the volume key 11*m* is kept pressed. Next, as shown in FIG. 7C, the minus key of the channel key 11*n* is pressed. The minus key of the channel key 11*n* is kept pressed.

By sequentially pressing three these keys, as shown in FIG. 7D, the function key 11*d* ("DVD" in the present embodiment) corresponding to the electronic device specified by the "back-to-other-category" setting is illuminated. By sequentially releasing the pressed television power key 11*c*, the minus key of the volume key 11*m* and the minus key of the channel key 11*n*, the illuminations of the function key corresponding to the electronic device specified by the "back-to-other-category" setting is turned off, thereby completing the change of setting.

Processing of the "back-to-other-category" setting and the "keep-last" setting is thus carried out.

Figures 8A, 8B, 8C:
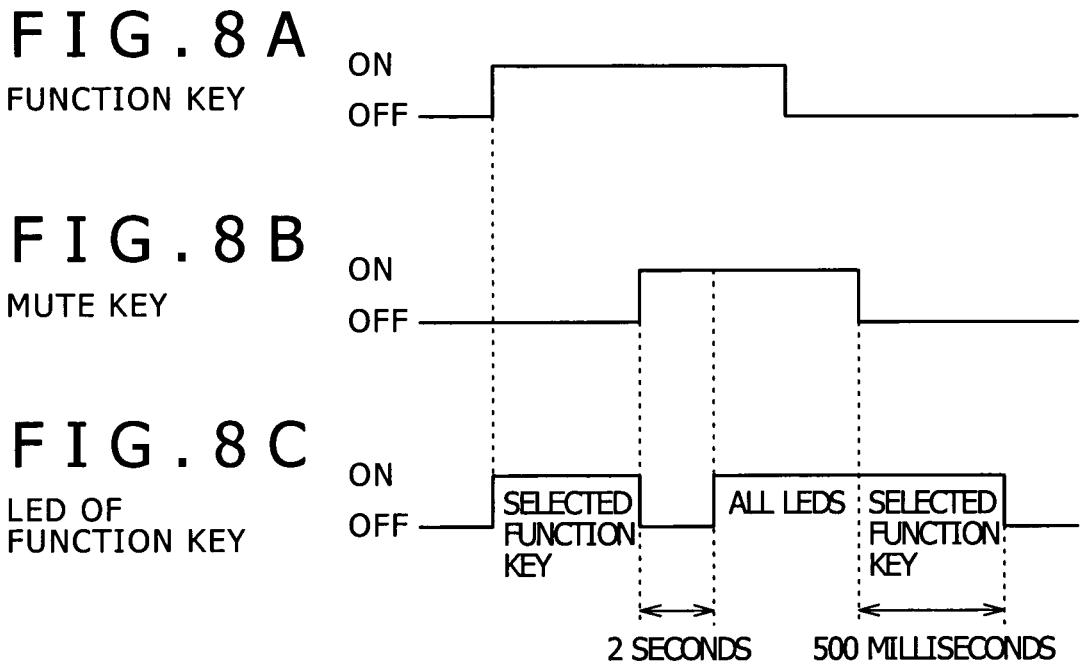
FIGS. 8A to 8C are explanatory drawings showing exemplary timing charts for a process of setting a destination of back-to-other-category in one embodiment of the present invention.

Paragraphs below will explain an exemplary process of setting a destination of the "back-to-other-category" setting, with reference to the timing chart in FIGS. 8A to 8C. FIG. 8A shows any one of the function keys 11*d* to 11*g* designated as the destination, FIG. 8B shows on/off of a mute key 11*l*, and FIG. 8C shows illumination/non-illumination of the function key.

Under the "back-to-other-category" setting, a destination for the "back-to-other-category" can be set, by a setting procedure of "sequential double pressing of (function key to be recovered)+(mute key)". It is therefore made possible to set to what electronic device the user wishes to unconditionally return the mode. An exemplary processing assumed herein is such as changing the destination for the "back-to-other-category" from "TV" to "DVD".

First, as shown in FIG. 8A, the function key 11*d* to be set as the returning destination ("DVD" in the present embodiment) is pressed. As shown in FIG. 8C, the LED of thus pressed function key 11*d* is turned on. Next, as shown in FIG. 8B, the mute key 11*l* is pressed. Upon the key-on of the mute key 11*l*, the LED of the function key 11*d* ("DVD") is turned off for a predetermined length of time. In this embodiment, the LED is set to turn off for 2 seconds.

After two-second turned off of the LED of the function key 11*d* ("DVD"), all function keys 11*d* to 11*g* ("DVD", "VTR", "AMP", "TV") are illuminated. Then, the pressed function key lid and the mute key 11*l* are released in this order. Upon releasing the mute key 11*l*, the function key to be illuminated change from all of the function keys 11*d* to 11*g* to the selected function key 11*d*, while the other function keys 11*e* to 11*g* are not illuminated. The selected function key 11*d* is illuminated only for a predetermined length of time, and then turned off. In this embodiment, the LED is set to turn off for 500 milliseconds.

The processing for setting the returning destination for the "back-to-other-category" is thus carried out.

It is therefore made possible to make the "keep-last" setting and the "back-to-other-category" setting, and further to switch the individual settings depending on state of use of the user.

According to this embodiment described in the above, the mode setting corresponding to a selected function key can be kept by making the "keep-last" setting on the remote controller. Accordingly, for the case where it is desired to operate continuously in a certain mode, it is not necessary to switch the function key every time the user starts to use the remote controller.

The "back-to-other-category" setting of the remote controller also makes it possible to automatically recover a predetermined mode setting even if the mode of the remote controller 1 is switched over, thereby allowing the user to preset a mode of basic use.

Furthermore, switching of the "keep-last" setting and the "back-to-other-category" setting depending on state of use by the user allows to customize the remote controller so as to suite user's convenience for the case where other types of electronic devices are connected. Another advantage is such that operation errors and misunderstanding may be avoided because the user made his/her own setting.

Still another advantage is such that any changes in the state of use caused by renewal or addition of the electronic devices can readily be coped with, only by changing the setting on the remote controller.

In the above-described embodiment, the RAM and the ROM are incorporated into the memory of the remote controller 1, whereas similar effects can be obtained by using other storage media. For example, it is also allowable to preliminarily store the settings of the remote controller in a detachable memory card, and cause another remote controller to read the memory card mounted thereon, so as to save labor of making the settings again.

In the above-described embodiment, the "sequential triple pressing of (television power key)+(volume minus key)+(channel minus key)" is adopted when the "keep-last" setting and the "back-to-other-category" setting are to be switched, whereas the keys are not limited to those in the above, and any other keys may be used for such a setting if necessary.

The exemplary processing described in the above embodiment assumed that the mode of the "back-to-other-category" setting as "TV", and that the mode is switched to "DVD". However, in the present invention, the modes are not limited thereto and may arbitrarily be set to other modes. The exemplary processing similarly assumed the mode of the "keep-last" setting as "TV", and that the mode is switched to "DVD". However, in the present invention, the modes are not limited thereto and may arbitrarily be set to other modes.

In the above-described embodiment, setting of the returning destination of the electronic device for the "back-to-other-category" is changed from "TV" to "DVD", whereas the setting is not limited thereto, and any electronic device can be set as the returning destination if necessary.

In the above-described embodiment, the "sequential double pressing of (function key to be recovered)+(mute key)" is adopted when the destination for the "back-to-other-category" is set, whereas the keys are not limited to those in the above, and any other keys may be set if necessary. The "sequential double pressing of (function key to be recovered)+(mute key)" is adopted to allow all function keys to illuminate after two-second turned off of the function key, and to allow the selected function key to be illuminated only for 500 milliseconds by releasing the mute key. Alternatively, the time periods for illumination/non-illumination may arbitrarily be set. The illumination pattern of the function key may be changed so as to flash a predetermined number of times, or so as to allow multi-color illumination, to thereby improve the visibility by the user.

The table described in the above embodiment, making correlation between the inputs and set modes to be stored in the memory of the remote controller 1, is such that correlating the first input with the DVD recorder 4, and the second input with the video deck 5. Alternatively, other settings may be selected to allow other various connections such as connecting the video deck 5 to the first input. Furthermore, it is allowable to provide a plurality of inputs, and to make settings respectively for devices to be connected.

The input switching operation on the television receiver 2 in the above-described embodiment is initiated by pressing the input switching key 11*a* of the remote controller 1. Alternatively, an input switching menu may be displayed on the display panel 26 so as to allow the user to select the input using the selection key 11*j*. It is still also allowable to provide input keys such as "input 1", "input 2" . . . and so on to the remote controller 1, to thereby allow the user to press the input keys for input switching.

The remote controller 1 or the television receiver 2 may be provided with an external input terminal allowing therethrough connection with an external network, and downloading of various data via a network. Because various electronic devices have newly been proposed in recent years, downloading of programs, data and so forth via the network can make connection even to such new electronic devices.

In the above-described embodiment, the remote controller is adopted to the device operation system in which the various peripheral devices are connected to the television receiver. Alternatively, the remote controller may be configured for an operation system in which a CD (compact disk) player, a tuner and so forth are connected to an amplifier configured so as to process audio signals switched among the devices. Alternatively, peripheral devices such as a printer and a memory may be connected to a computer so as that a single remote controller can be used to operate these peripheral devices en bloc. In this case, newly function keys such as "CD" and "TUNER" may be provided to the remote controller, so as to allow operations similar to those in the above-described embodiment.

In the above-described embodiment, the present invention is adopted to the remote controller capable of sending and receiving infrared signals. Alternatively, the present invention may be applicable to a remote controller capable of sending and receiving any wireless signal based on other signal formats, or a remote controller configured to be wired with a communication cable.

The present document contains subject matter related to Japanese Patent Application JP 2005-185277 filed in the Japanese Patent Office on Jun. 24, 2005, the entire contents of which being incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A remote controller, having a plurality of keys arranged thereon, for sending a remote control signal assigned to each of the keys upon being operated to remotely control a target device, and being configured to send a remote control signal corresponding to each of a plurality of target devices by mode switching, the remote controller comprising:

a plurality of function keys provided for each of the plurality of target devices, wherein each function key is configured to select the target device to be remotely controlled;

a key illuminating section configured to individually illuminate the plurality of function keys;

a controller configured to cause, if a certain function key out of the plurality of function keys is pressed, the key illuminating section to illuminate the pressed function key for a predetermined length of time and to output a remote control signal for the target device corresponding to the pressed function key when any key of the plurality of keys is pressed during the illumination of the pressed function key, and output a remote control signal for a preliminarily registered target device if any key of the plurality of keys is pressed while none of the function keys are illuminated; and a transmitter configured to send the remote control signal output by the controller.

2. The remote controller as claimed in claim 1, wherein the controller is configured to set a mode in which, in response to a pressed key of the plurality of keys, the remote controller outputs the remote control signal for the target device corresponding to the last-pressed function key until another function key is pressed.

3. A remote control method for remotely controlling a target device by sending a remote control signal assigned to each of a plurality of keys provided in a remote controller, and sending a remote control signal corresponding to each of a plurality of target devices by mode switching, the remote control method comprising:

selecting the target device to be remotely controlled by using a plurality of function keys provided for each of the plurality of target devices;

illuminating the plurality of function keys individually;

if a certain function key out of the plurality of function keys is pressed, causing illumination of the pressed function key for a predetermined length of time, and outputting a remote control signal for the target device corresponding to the pressed function key when any key of the plurality of keys is pressed during the illumination of the pressed function key; and if any key of the plurality of keys is pressed while none of the function keys are illuminated, outputting a remote control signal for a preliminarily registered target device.

* * * * *